United States Patent [19]

Fredrickson

[11] Patent Number: 4,627,542

[45] Date of Patent: Dec. 9, 1986

[54] DISPLAY APPARATUS HAVING A MECHANISM FOR TILTING SHELVES

[75] Inventor: Howard J. Fredrickson, Cannon Valley Township, Goodhue County, Minn.

[73] Assignee: Cornelius Cannon, Inc., Cannon Falls, Minn.

[21] Appl. No.: 476,751

[22] Filed: Mar. 18, 1983

[51] Int. Cl.[4] ..... A47F 5/13

[52] U.S. Cl. ..... 211/150; 211/59.2; 280/79.3

[58] Field of Search ..... 211/150, 149, 49.1, 211/59.2; 708/7; 280/79.2, 79.3

[56] References Cited

U.S. PATENT DOCUMENTS

| | | | |
|---|---|---|---|
| 2,916,293 | 12/1959 | Long | 280/79.3 |
| 3,111,915 | 11/1963 | Gray | 211/150 X |
| 3,981,511 | 9/1976 | Foster | 211/150 X |
| 4,067,265 | 1/1978 | Watson | 211/150 X |
| 4,191,296 | 3/1980 | Morgan | 211/150 X |

*Primary Examiner*—Robert W. Gibson, Jr.
*Attorney, Agent, or Firm*—Henry C. Kovar

[57] ABSTRACT

Apparatus for transporting and displaying goods has a frame having a base, a pair of opposed side frames, a shelf support post in each frame, and a vertical row of keyholes in each post for pivotal support of a plurality of shelves; the shelf for the apparatus has a center section for supporting a tray, a front barrier for retaining a tray on the shelf, a pair of opposed transverse arms and a key on an outer end of each arm, and a rotator lever on a back of the shelf; a tilt column is connectible to the shelf levers and as the tilt column goes up and down, the shelves pivot from a horizontal transport position to a tilted or inclined display position and back to the horizontal position.

A tilt mechanism is articulately connected in between the frame and the column by a hinge on the frame and a hinge on the column, the tilt mechanism has an adjustable stop and a multi-position lock that enables positive positioning of the shelves at several angles, for example, 0, 10, 15, 20, 25 and 30 degrees of tilt, as the shelves pivot, the shelf levers and the column travel through an arcuate path and the column is guided through the arcuate path by upper and lower radius arms which pivot from the side frame posts, the shelves are removable and replaceable from the apparatus when the column is at its maximum height, when the column is below its maximum height the shelf keys restrainingly engage the side frame posts and provide lateral support from the side frames, the shelves may be placed in many positions and various combinations of quantities and spacings of shelves may be utilized.

29 Claims, 17 Drawing Figures

DISPLAY APPARATUS HAVING A MECHANISM FOR TILTING SHELVES

BACKGROUND OF THE INVENTION

1. Field of the Invention

This invention pertains to a goods display apparatus having a mechanism enabling shelves to be horizontal for loading and for transfer, and enabling the loaded shelves to be subsequently tilted to a predetermined angle of inclination for display and feeding of the goods on the shelves. The apparatus is especially suited for the business of retailing bread and bakery products.

2. The Prior Art

The distribution and retailing of bread, pastries and similar goods has been done with cardboard boxes or plastic or wire cases in combination with fixed store shelving. The factory loads the boxes or cases with bread, the loaded boxes or cases are placed on a truck and then unloaded at a retailing site. The shelves are then manually stocked from the boxes or cases. The bread is excessively handled, bags are unintentionally opened, bread is stacked upon itself and some bread is squashed. The product loss and labor required is a significant portion of the cost to a consumer, when bread and bakery goods are purchased from a fixed shelf.

A more advanced alternative is a plastic or wire case in which the bread is placed on end in the case, much like beverage bottles. The cases are then stocked on edge at a retailers and consumers pull out loaves of bread. Again, the bread packages tend to damage each other and when a customer pulls out one loaf, several adjacent loaves may fall on the floor. This type of arrangement eliminates the step of transfer from case to shelf by store labor.

One of the problems of the practice of using cases is that people steal the cases, or they keep the cases. People take the cases home and use them for car parts, camping, sporting goods, beer and soda drinks, magazine boxes and the like. People also take the heavy duty commercial plastic and wire trays and use them for garage shelves and other purposes. The shrinking of cases and trays is both internal and external. The actual cost to a retail customer will vary from location to location and goods to goods, but one survey came up with an opinion that the cost of case shrinkage in the dairy industry comes to 4¢ per gallon of milk retailed.

Businesses using cases are being offered and are considering 3-sided cases that do not nest, in order to combat case shrinkage. Regardless, emptied cases have to be inventoried, sorted out and returned to the source of goods.

A further practice uses a wheeled cart that has fixed horizontal shelves. The shelves are loaded at the factory and the cart is transferred to a retailing site while loaded with goods. The consumer buys goods directly out of the cart. Typically, each cart shelf has one layer of goods and the packages do not squash one another during transit. There are no cases to lose, but the cart must be returned for reloading with goods. The problem with these carts has been that the shelves are fixed and that consumers pick out the front rows of goods but will not stick their arms into the cart to grasp and pull out the back rows. Consequently, the cart is not emptied and must be manually emptied by the retailer's employees or the cart is sent back to the factory with unsold goods.

Another attempt has been the use of a cart having a fixed inclined shelf that will self-feed bread and pastry products downward to a front side from which the consumer withdraws selected goods. It has been found that loaves of bread collapse and become shorter under compression during transit. The goods also jump off the shelf and fall out of the cart during transit; the only way to prevent "jump out" is to use a very high front barrier which in turn requires shelves be spaced apart the thickness of the goods plus the height of the high barrier. Further, the individual shelves are very difficult to load, and can only be effectively loaded from the back.

Attempts have been made to devise a cart having a shelf that can be tilted from horizontal to inclined. Past efforts have been unsuccessful because no one has been able to devise a mechanism that can easily tilt loaded shelves. The forces have been tremendous. For example, a cart that is configured to have a shelf four loaves wide and two loaves deep at 1½ pounds per loaf has 12 pounds of bread per shelf. The shelf and bread support be it a removable tray or a fixed tray, probably weigh 5 pounds. In the U.S. market, a good height has been found to be eleven layers. Eleven filled shelves weigh about 190 pounds. The typical grocery store or bread store clerk is a high school student, and many times a young woman. These people have not had the strength to tilt a full load of bread and no one has been able to devise a cart enabling them to do it.

The foregoing problems apply to other goods to greater or lesser degrees. Examples of other goods are motor oil, produce, boxed goods, bottled goods and the like; the problems are not just restricted to bread even though bread is the goods upon which this effort has been focused.

OBJECTS OF THE INVENTION

It is an object of the present invention to provide apparatus for display and retailing of goods, having structure enabling tilting of shelves for goods from a horizontal loading to an inclined display position.

It is an object of the present invention to provide transport and display apparatus having mechanism for easily tilting loaded shelves from a horizontal transport to an inclined display position.

It is an object of the present invention to provide a mobile display apparatus having multiple and easily tiltable shelves and a mechanism for easily tilting all of the shelves concurrently.

It is an object of the present invention to provide a cart having removable and replaceable pivotal shelves, with the shelves providing lateral support for side frames of the cart.

These and other objects of the present invention will become manifest upon examination by those skilled in the art of the teachings herein.

SUMMARY OF THE INVENTION

In accordance with the principles of the present invention, display apparatus for multiple and easily tiltable shelves has an upright frame with opposed sides and a fore end and an aft end, pivots in each side for supporting a plurality of shelves one above the other, a shelf tilt column which has rotators connectible to the shelves at a distance from the pivots, and a tilt mechanism in between the column and the frame; the column follows the shelves through an arcuate path and the tilt mechanism has a hinged connection to the frame and the column enabling the tilt mechanism to move in between the frame and a path followed by the column, and the tilt mechanism has a lock mechanism which locks the column and shelves in selectable positions.

AS SHOWN ON THE DRAWINGS

Figure 1:
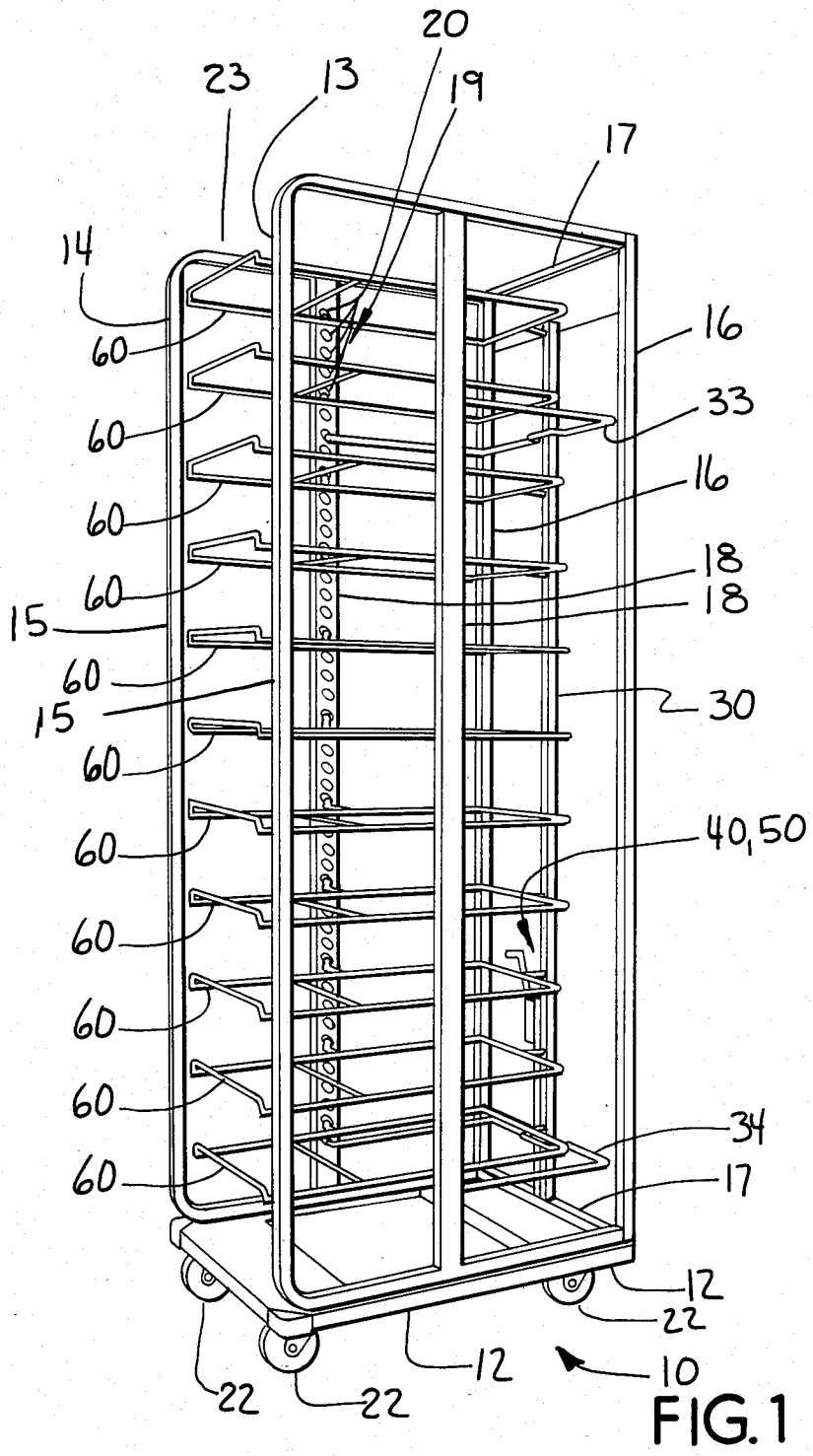
FIG. 1 is a perspective view looking down at the front and left side of the preferred embodiment of a variable tilt shelf cart according to the present invention.
Figure 2:
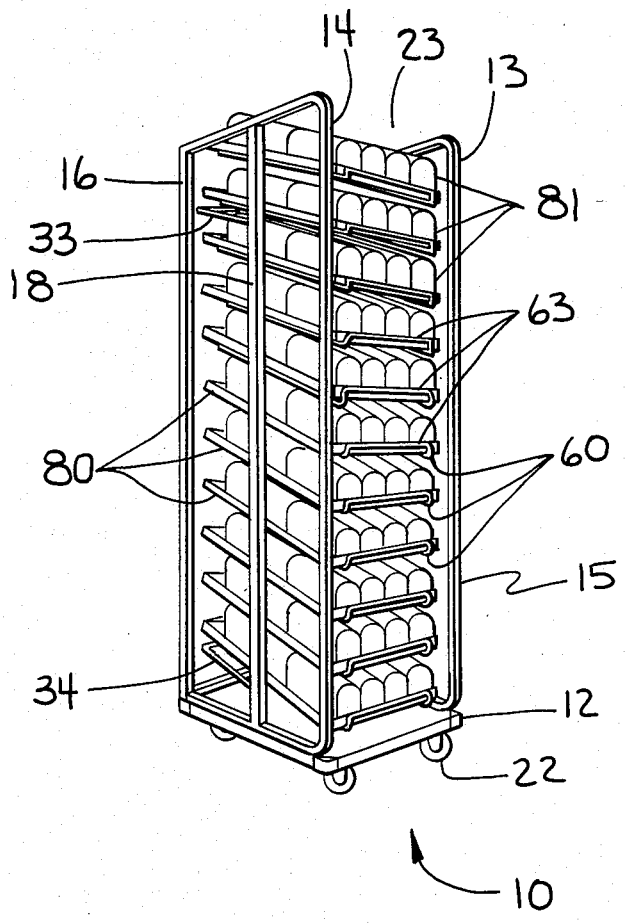
FIG. 2 is a perspective of the front and right side of the structure of FIG. 1, loaded with bread trays and with the shelves tilted.
Figure 3:
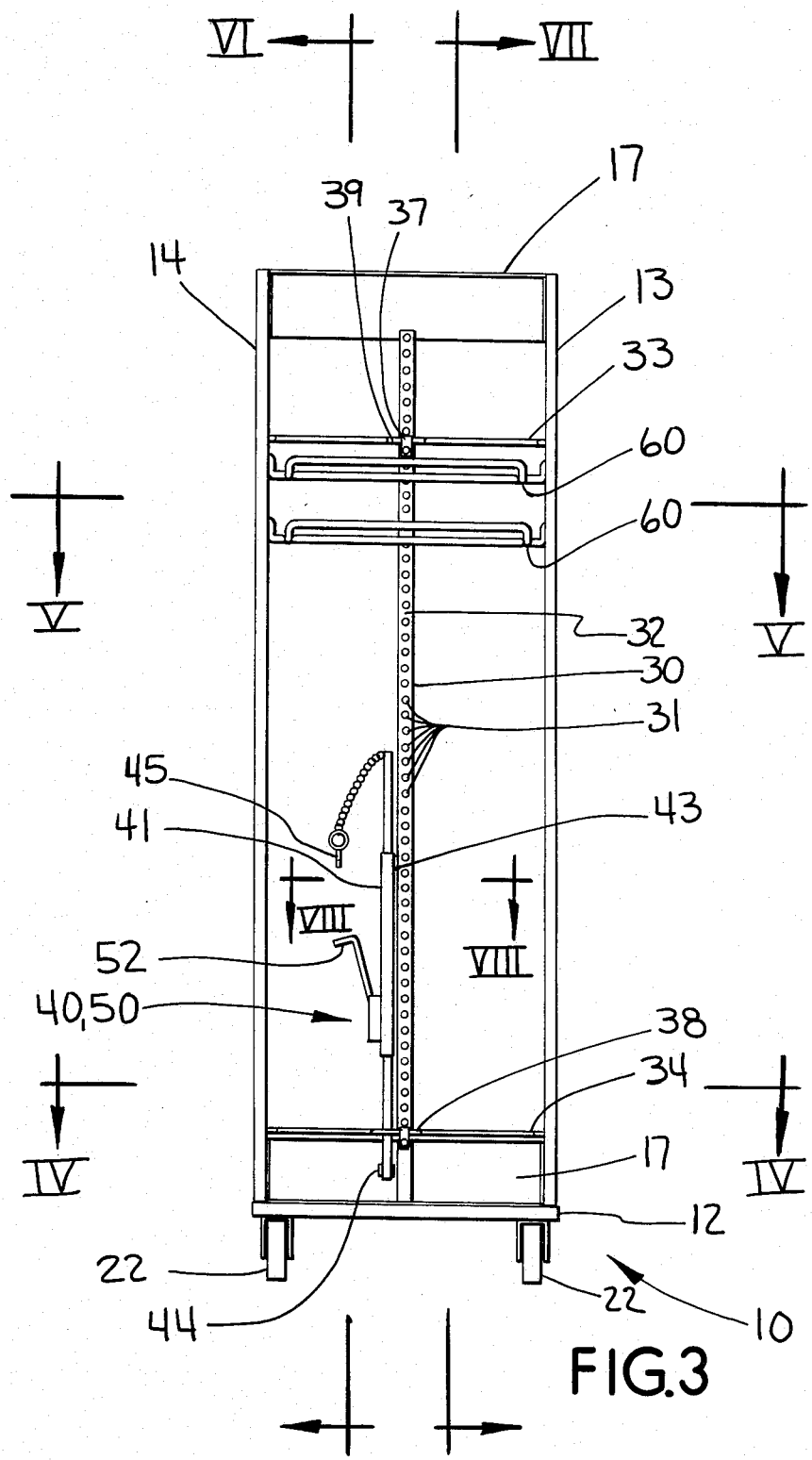
FIG. 3 is a front elevational view of the cart of FIG. 1.
Figure 4:
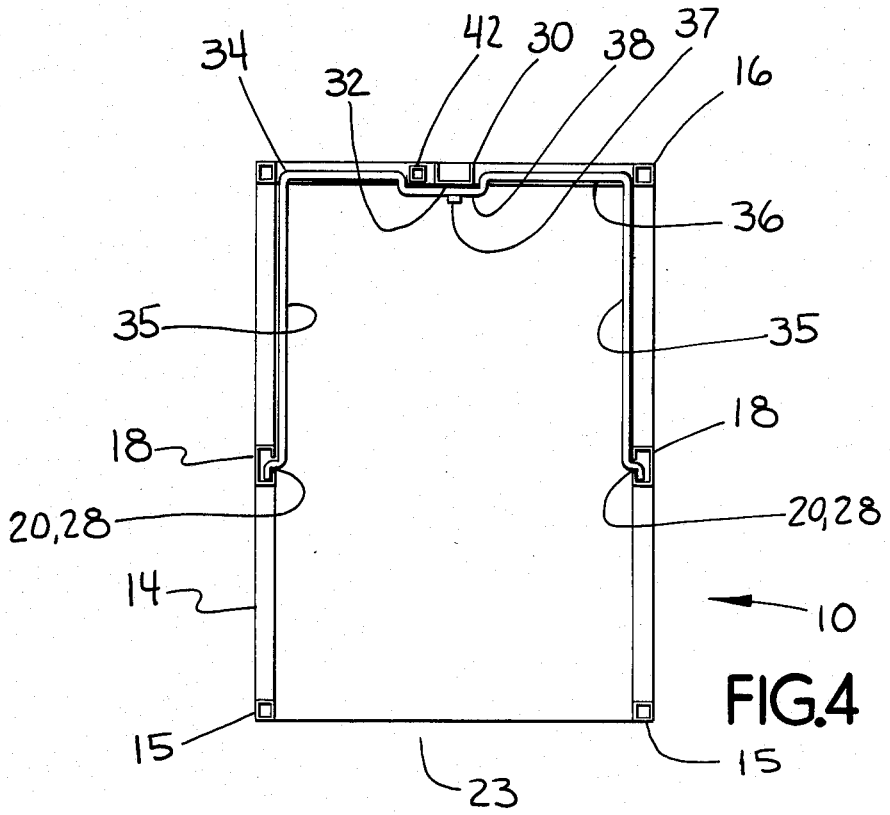
FIG. 4 is a downward looking sectional view taken through lines IV—IV of FIG. 3.
Figure 5:
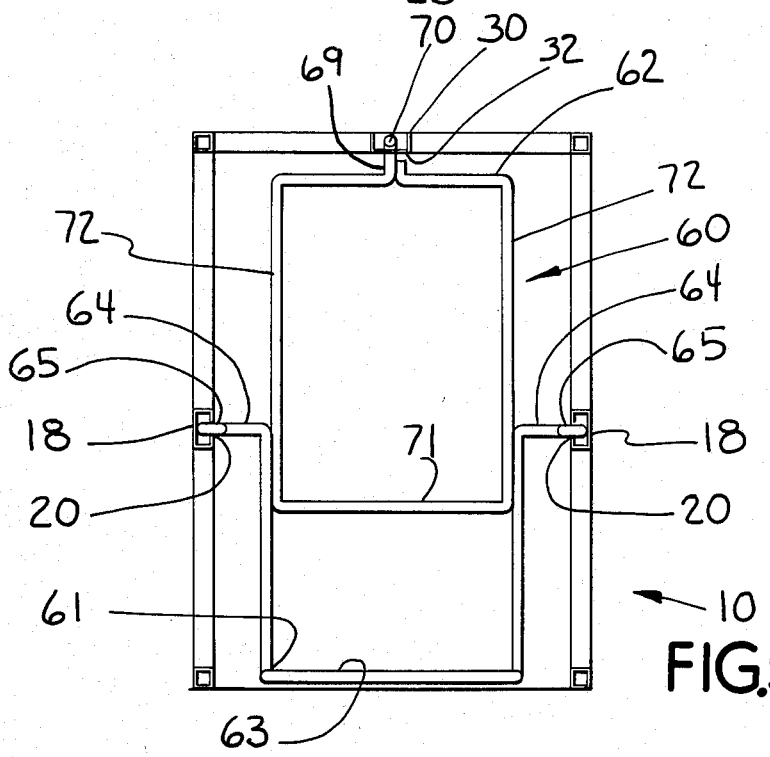
FIG. 5 is a downward looking sectional view taken through lines V—V of FIG. 3.

The principles of the present invention are particularly useful when embodied in an apparatus shown in FIGS. 1 and 2 and generally referred to by the numeral 10. The apparatus 10 may be stationary, but preferably is a mobile cart for the transportation and display of goods, and hereinafter the apparatus 10 will be referred to as the "cart" 10.

The cart 10 has a structural frame 12 which includes a right side frame 13 and has a left side frame 14 which are opposed to each other and which are mounted to a base 21. Each side frame 13, 14 has a front post 15. The front posts 15 jointly define an open front end 23 of the cart 10. Each of the side frames 13, 14 has a back post 16 and between the back posts 16 is a back frame 17 which defines a back end of the cart 10. Each side frame 13, 14 has a upright shelf support post 18 which has pivots, generally indicated by the numeral 19, for pivotal support of shelves 60 as will be described. The pivots 19 in each shelf support post 18 are a vertical row of spaced apart keyholes 20. Caster wheels 22 are secured to the base 21 and enable the cart 10 to be mobile and freely wheeled about. The frame front posts 15, which jointly define a front end 23 of the cart, may be used as handles to wheel the cart 10 about.

Figure 11:
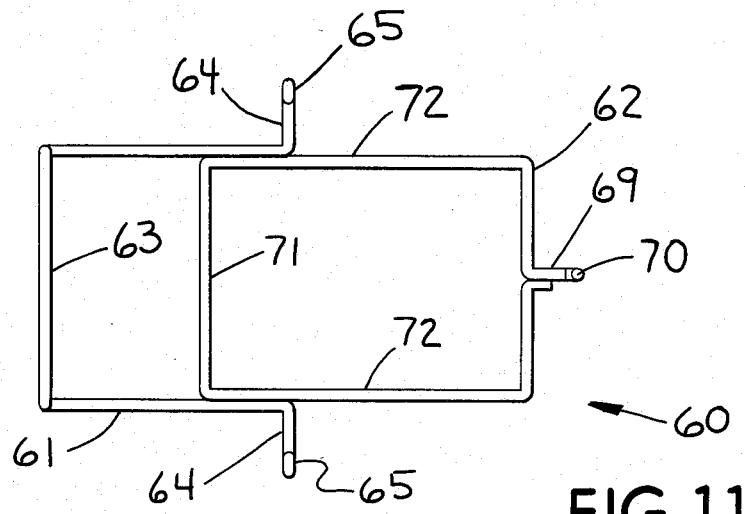
FIG. 11 is a top plan view of the shelf for the cart.
Figure 12:
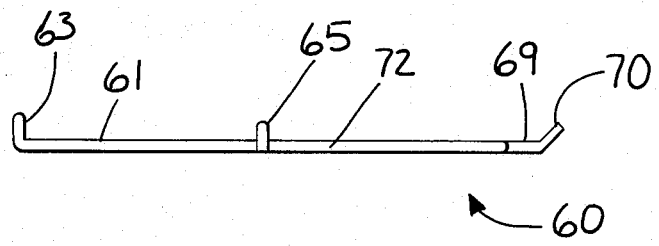
FIG. 12 is a side elevational view of the right side of the shelf of FIG. 11.
Figure 13:
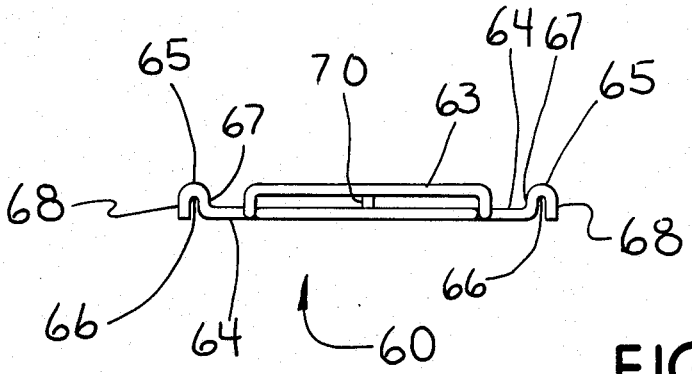
FIG. 13 is a front elevational view of the shelf of FIG. 11.

The shelves 60 are all identical and completely interchangeable with each other. As best shown in FIGS. 11, 12 and 13, each shelf 60 has a U-shaped nose 61 of formed wire which is welded to the front of a closed loop 62 of similar wire. The U-shaped nose 61 has a upstanding front barrier 63 and a pair of opposed transversely extending arms 64. Each arm 64 has a key 65 for pivotal support of the shelf 60 and for lateral restraint of the side frames 13, 14 as will be described. Each key 65 has a journal 66 for support of the shelf 60 and an inside retainer 67 and an outside retainer 68 for engaging a respective side frame 13, 14. Each shelf 60 also has a rotator leg lever 69. The leg lever 69 is preferably on the back of the shelf 60, and has a bent foot 70. The closed loop 62 has a front support 71 centrally positioned in the shelf 60. The shelf 60 as shown, is configured for support of a tray 80 for loaves of bread 81. The trays 80 come in various configurations, usually of wire, aluminum sheet or molded plastic with a ribbed bottom. The closed loop 62 is sized and the front support 71 is positioned so that a tray 80 cannot fall through the shelf 60. The barrier 63 keeps a tray 80 from falling off the front of a shelf 60, and the tray 80 is laterally positioned by the keys 65. The transverse arms 64 position the fore-aft members 72 of the shelf 60 in a support position spaced well inside of the side edges of a tray 80. The shelves 60 are mountable in and normally used in the frame 12. The shelf keys 65 go into the keyholes 20 and the journals 66 ride upon the keyholes 20. Each shelf 60 is pivotally mounted in a respective pair of keyholes 20 on a horizontal level.

A movable shelving tilt column 30 has rotators 31 for rotating the shelves 60. Each rotator 31 is preferably a round aperture pierced in a front surface 32 of the column 30. The column 30 is movable through a complex motion which includes upward or downward movement in the vertical or X-axis of the cart 10,and forward or rearward movement in the fore-aft or Z-axis of the cart 10. The rotators 31 receive the leg lever 69 and bent foot 70 on the shelf 60, and when the column 30 is down, the shelves 60 are level and when the column 30 is raised, the shelves 60 become tilted or inclined. As the shelves 60 pivot, the column 30 has to follow in an arcuate path to stay with the pivoting shelves 60. The column 30 is held and guided in an arcuate path by an upper radius pivot arm 33 and a lower radius pivot arm 34. Each pivot arm 33, 34 is generally U-shaped and has a pair of radius rods 35 which are pivotally mounted in the side frames 13, 14 and in the keyholes 20, and which define the radius through which the column 30 is movable in an arcuate path of motion to conform with an arcuate path defined by the movement of shelf levers 69. The radius rods 35 are connected to the column 30 by a column arm 36 which is in between the radius rods 35 on each of the upper arm 33 and the lower arm 34. Each arm 33, 34 is pivotally mounted to the column 60 by a hinge clip 37. The lower arm 34 has a wide U-shaped offset 38 which extends around the front of the column 30 and a column tilt mechanism 40. The upper arm 33 has a narrow U-shaped offset 39. The offsets 38, 39 laterally position the column 30 and place the column arms 36 behind the column front surface 32. Each radius rod 35 has a dog-leg offset 28 inside of a respective keyhole 20 and this connection forms the pivotal connection of both the upper and lower pivot arms 33, 34 to the pivots 19.

The tilt mechanism generally indicated by the numeral 40, and shown in detail in FIGS. 8, 9 and 14–17, movably connects the tilt column 30 to the frame 12. It is the tilt mechanism 40 that moves the column 30 up or down and locks the column 30 in position to fix an attitude of the shelves 60. The tilt mechanism 40 has a slide 41 articulately connected to the column 30 by an upper hinge 43, and a slideway 42 articulately connected to the frame 12 by a lower hinge 44. The slide 41 moves up and down upon the slideway 42 and a stop pin 45, which hangs from the slideway 42 by a chain or other connector, may be placed into a selected one of several stop receivers 46 for positively stopping upward travel of the slide 41 and the tilt of the shelves 60 at a selected angle which may be an angle such as ten, fifteen, twenty, twenty-five or thirty degrees which is so indicated by indicia stamped into the slideway 42 adjacent to the appropriate stop receiver 46 as shown in FIG. 10. When the stop pin 45 is in the lowest pin receiver 46, which is shown without designation in FIG. 10, the slide 41 must be completely down and the slide is held completely down and cannot be moved, and the shelves 60 are fixed in a horizontal position for travel as seen in the bottom portion of FIG. 6 and FIG. 15. At the top of the slideway 42 is a fixed stop 47 which limits the maximum upward travel of the slide 41 and which also prevents the slide 41 from coming off of the slideway 42 and also prevents the shelves 60 from being over-tilted.

Figure 6:
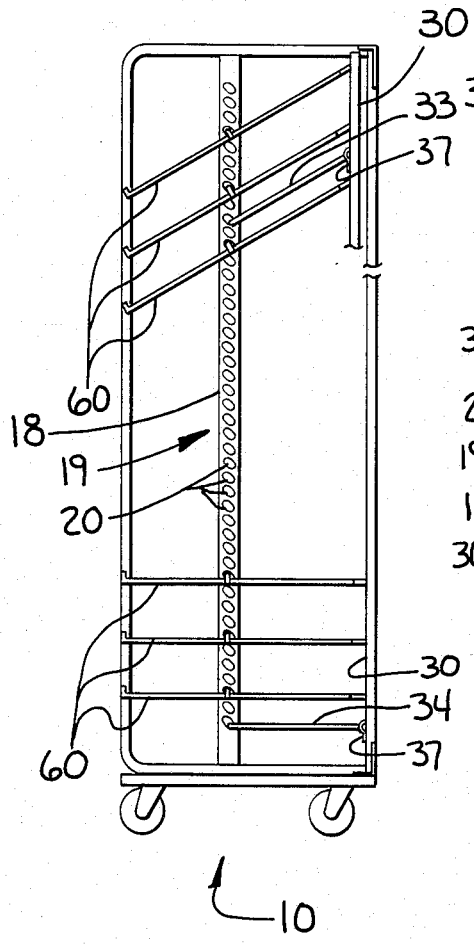
FIG. 6 is an elevational sectional view taken through lines VI—VI of FIG. 3.
Figure 7:
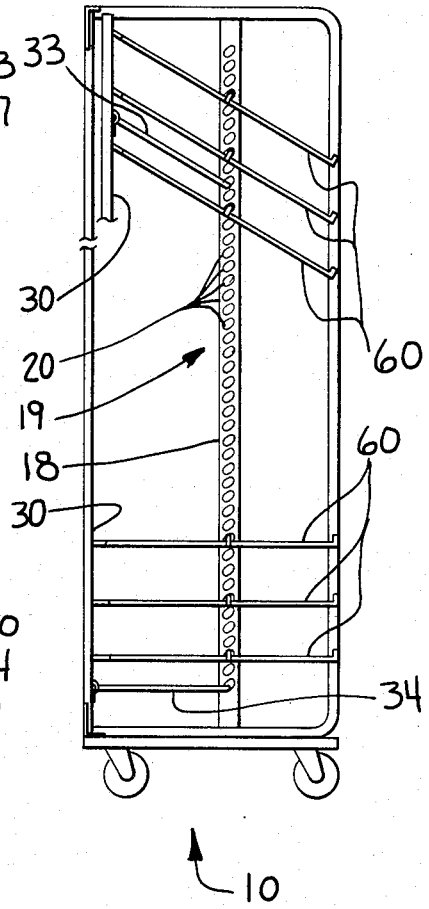
FIG. 7 is an elevational sectional view taken through lines VII—VII of FIG. 3.
Figure 8:
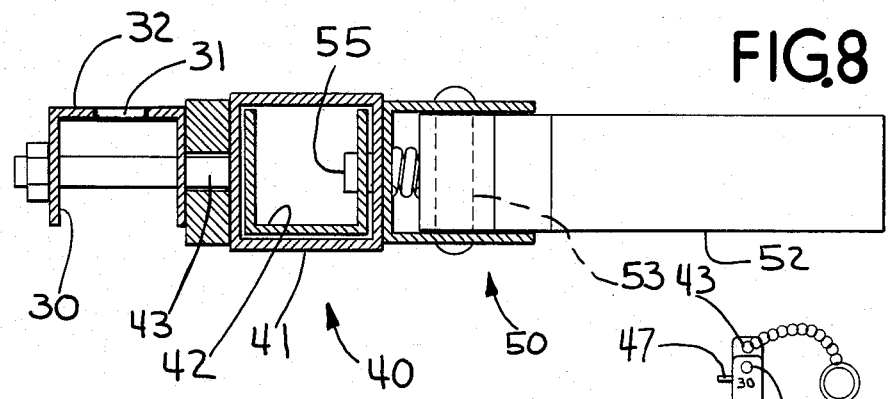
FIG. 8 is a downward looking view taken through lines IIX—IIX of FIG. 3.
Figure 9:
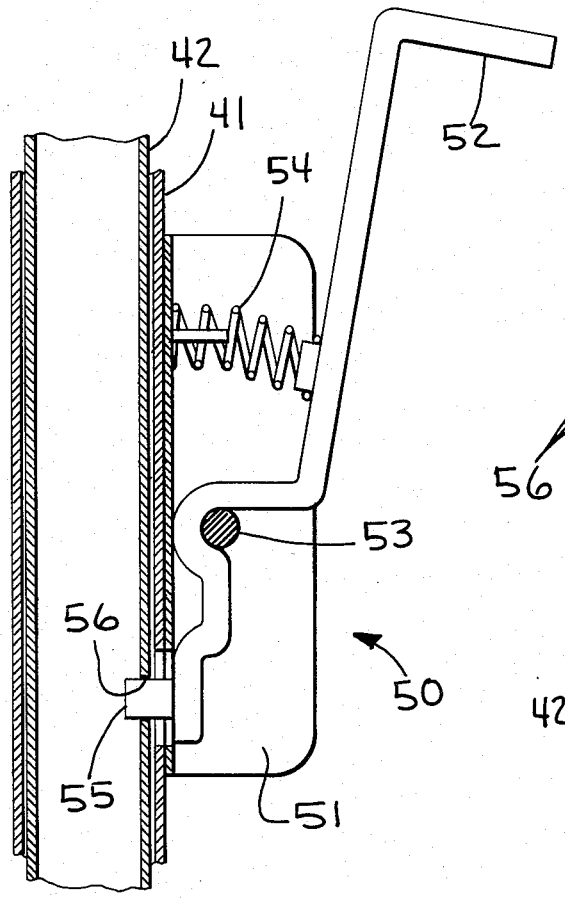
FIG. 9 is a detail sectional view of the latch of FIG. 8.
Figure 10:
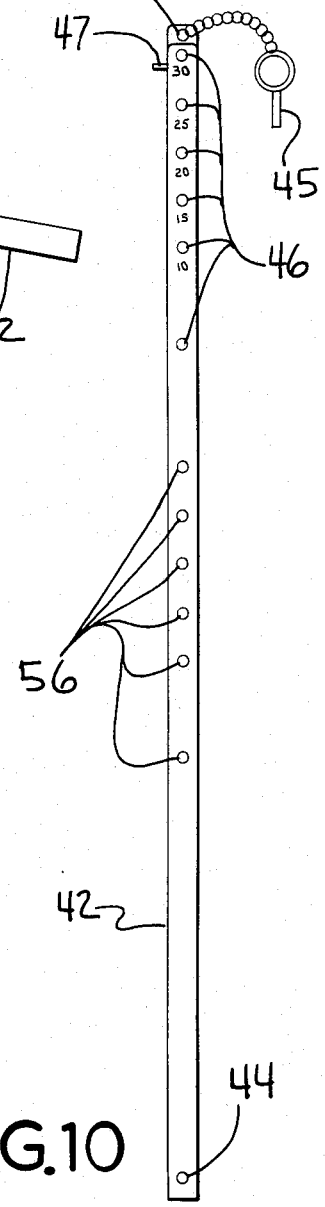
FIG. 10 is a detail side view of the slide column of FIG. 8.
Figure 14:
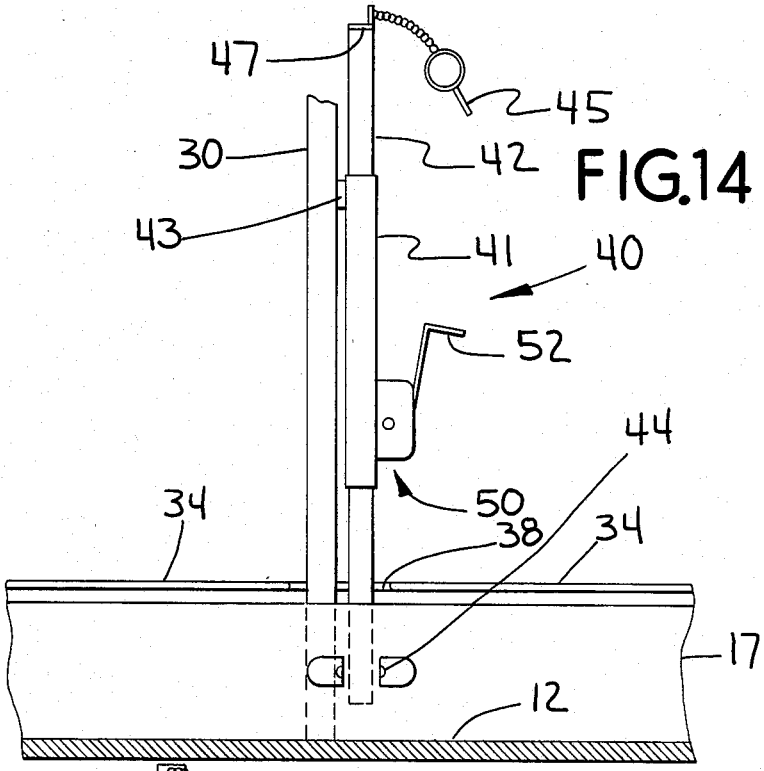
FIG. 14 is a rear elevational detail view of the tilt mechanism of the cart of FIG. 1.
Figure 15:
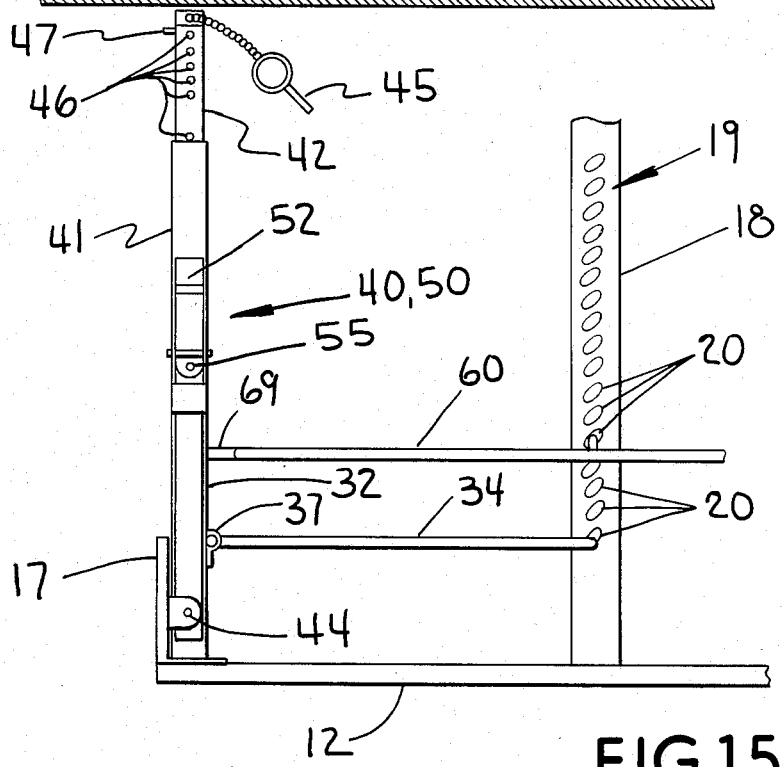
FIG. 15 is a side elevational view of the tilt mechanism of FIG. 14 in a down position.
Figure 16:
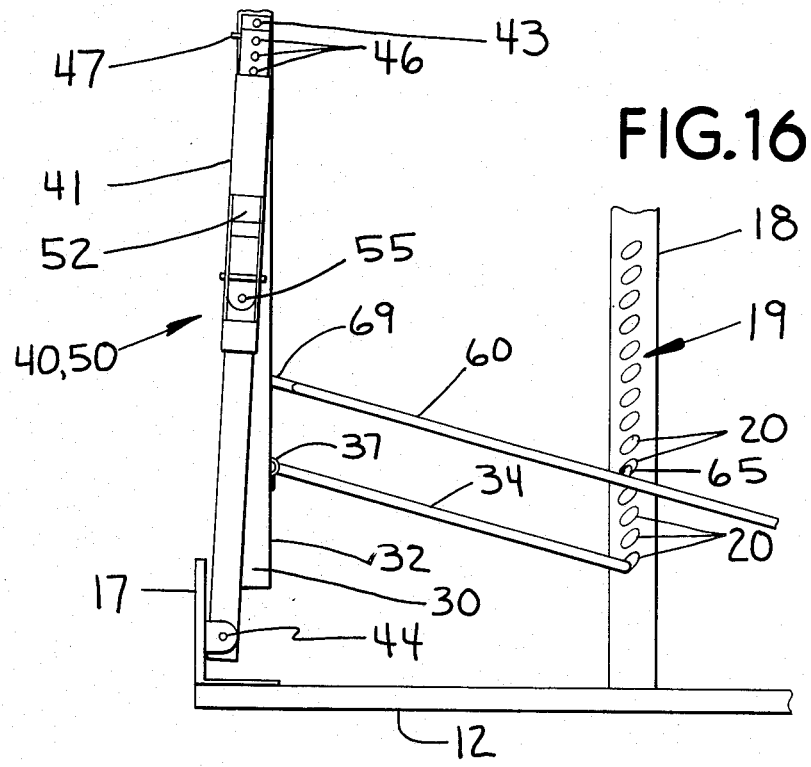
FIG. 16 is a side elevational view of the tilt mechanism of FIG. 14 in a first elevated and tilted position.
Figure 17:
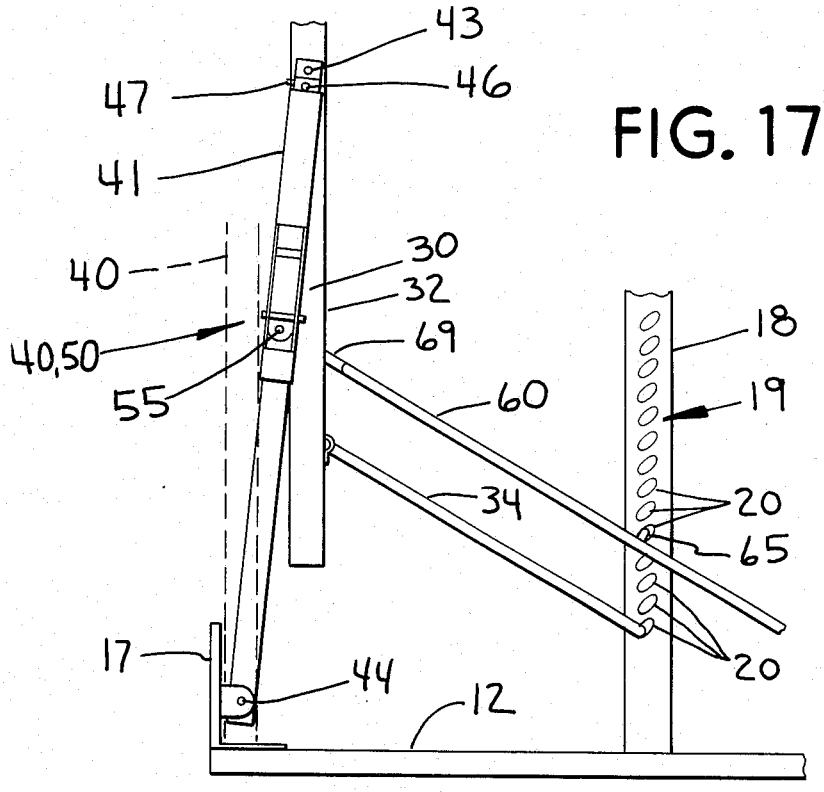
FIG. 17 is a side elevational view of the tilt mechanism of FIG. 14 in a second and higher angle elevated and tilted position.

A lock mechanism, generally shown by the numeral 50 and best shown in FIGS. 8 and 9, is mounted to the slide 41 by a bracket 51. A handle 52 depends from a fulcrum pin 53 in the bracket 51, and a spring 54 biases the handle 52 and a handle mounted lock pin 55 into locking engagement in a lock aperture 56 of the slideway 42. There is a lock aperture 56 for each predetermined desirable angle of inclination of the shelves 60; specifically there is a lock aperture 56 for each of zero, ten fifteen, twenty, twenty-five and thirty degrees shelf inclination. Each lock aperture 56 corresponds to an equivalent stop receiver 46. For example, if the stop pin 45 is placed in the twenty degree stop receiver 46, the handle 52 is pulled up and toward the center to disengage the lock pin 55, and by pulling upward on the handle 52 the slide 41 will go upward until it physically contacts and is stopped by the stop pin 45, and then, when the handle 52 is released, the stop pin 55 will go right into a lock aperture 56 for twenty degrees and the slide 41 and column 30 will be in a position to tilt the shelves 60 at an inclination of twenty degrees, such as is shown in FIG. 16. In FIG. 17, the stop pin 55 is shown in the thirty degree stop receiver 46 and the lock pin 55 will be in the corresponding thirty degree lock aperture 56 and the shelves 60 will be inclined forward thirty degrees. FIG. 14 shows the tilt mechanism 40 from the rear and the stop pin 45 is in the lowest or zero angle stop receiver 46 such as would be the case for loading of the shelves 60 or for transit of the apparatus 10. FIG. 15 is a side view of FIG. 14 with the stop pin 45 removed and the tilt mechanism 40 operable for raising the column 30 for tilting the shelves 60. Movement of the column 30 and tilt mechanism 40 is best shown in FIGS. 6, 7, 15, 16 and 17. As each individual shelf 60 rotates, its leg lever 69 displaces through an arcuate path. All of the shelves 60 always remain parallel to each other so the leg levers 69 are always one above the other and always form a vertical row. The column 30 must follow the leg levers 69 or there will be binding between the column 30 and the levers 69. The effective length of the radius rods 35 is substantially the same as the length of a radius from the shelf journals 66 to the leg lever 69. The radius rods 35 guide the column through a path of motion that goes both upward and downward (in the X-axis) but also forward and backward (in the Z-axis) so that the movement of the column is identical to the movement of the leg levers 69 of every shelf 60. During this complex movement of the column 30, the articulated connection of the tilt mechanism 40 to the frame 12 and the column 30 enables the tilt mechanism 40 to follow the movement of the column 30 with binding. Specifically, the tilt mechanism 40 rotates forward in the bottom hinge 44, and rotates backward in the upper hinge 43 as the column 30 goes upward; this rotation is reversed when the column decends, the tilt mechanism 40 is thus movable through a path between the frame 12 and the path of the tilt column 30. The handle 52 serves both to release the lock pin 55 and to elevate or lower the slide 41 because the handle 52 goes up and down with the slide. The tilt mechanism 40, as previously mentioned, moves in between the frame 12 and the column 30 and is rotatable from the back end 17 toward the frame front end 23.

The keyholes 20 are obround holes sized to accept the shelf keys 65. The keyholes 20 are inclined forward from vertical as best seen in FIG. 6 or FIG. 7. The angular amount of the key 20 inclination is identical to the maximum amount of shelf 60 inclination that the column 30 and tilt mechanism 40 can provide. For example, if the shelves 60 can be tilted a maximum of thirty degrees, the keyholes 20 will be inclined forward of vertical a like thirty degrees. The shelf keys 65 are perpendicular to the plane of the shelf 60, specifically the keys 65 are vertical while the closed loop 62 and U-shaped nose 61 are horizontal. The frame 12 will accept or release shelves 60 only when the column 30 is at its maximum height or maximum inclination setting. For example, if the column 30 and tilt mechanism 40 will give a thirty degree inclination of the shelves 60, the keyholes 20 are inclined thirty degrees forward. The column 30 and slide 41 are raised to the thirty degree position and locked, and a shelf 60, or all of the shelves 60 may then be installed in or removed from the frame 12. A shelf 60 is installed by turning the shelf 60 clockwise or counter clockwise approximately forty-five degrees about the length of the leg line 69 and inserting the foot 70 and leg lever 69 into a selected rotator 31. One of the keys 65 is then inserted through a selected keyhole 20 and into a support post 18. The shelf 60 is then turned so that it is transversely horizontal but still tilted fore/aft and the shelf's 60 other key 65 is inserted into the opposite selected keyhole 20. The shelf 60 then falls into place with the key journals 66 each resting on the bottom of the respective keyholes 20, and the leg lever 69 in a rotator 31 with the foot 70 being turned up inside of the column 30 so that the leg lever 69 cannot fall out of the rotator 31. All of the shelves 60 are thus installed, the lowest shelf 60 first. During removal, the uppermost shelf 60 is removed first and then so forth until the lowest shelf 60 has been removed. All of the shelves 60 are identical and may be mixed in any order. The keyholes 20 are all identical to each other, and the rotators 31 are all alike. The keyholes 20 are in a vertical row, aggregately are referred to as the pivots 19, the rotators 31 are likewise in a vertical row, and the entire row of rotators 31 moves en masse and all together, simultaneously and concurrently. The keyholes 20 are preferably evenly spaced from each other, for example each keyhole 20 may be one and one-quarter inch above the next lower keyhole 20. The keyholes 20 are coded with indicia stamped into the metal adjacent a respective keyhole 20. For example, a specific version of the apparatus 10 has a vertical row of fifty-two keyholes 20 in each support post 18. All of the keyholes 20 are marked with their respective numerical value as counted from the bottom except that keyholes 20 numbers"2, 7, 12, 17, 22, 27, 32, 37, 42, 47 and 52"are stamped "B" instead of having a number. The same markings are stamped in the column adjacent the respective rotators 31. The keyholes 20 and rotators 31 marked "B" are spaced from each other the proper amount for loaves of bread. When the column 30 is down in its lowest or zero position, the respective keyholes 20 and rotators 31 form a horizontal plane for support of a shelf 60. For example, the lowest level and all higher levels of "B" are horizontal, and level number "25" and all other numbered levels are horizontal. The user of the cart 10 merely assembles shelves 60 into the cart 10 using these markings for guidance.

The pivots 19, specifically the keyholes 20 in the support posts 18 are spaced from the column 30 a distance approximately one-half the length of the cart 10. Specifically, the pivots 19 are usually in a row positioned closer to the front end 23 of the cart 10 and then to the back end 17 of the cart 10. The pivots 19 are preferably positioned from the column 30 a distance in the range of forty percent but less than sixty percent of the distance between the column 30 and the cart front end 23. This arrangement has been found to place most of the weight of the shelves 60, trays 80 and bread 81 upon the pivots 19, and the force required to tilt the shelves and bread can be kept to under twenty-five pounds, enabling a small girl to operate the tilt mechanism 40 even when the cart 10 is fully loaded. A natural downward load is desirable upon the column 30 and to obtain this downward load, the pivots 19 are positioned from the column 30 a distance that is more than half but preferably less than sixty percent of the depth of the cart 10.

The upper pivot arm 33 is positioned in between the highest and lowest keyholes 20 and rotators 31 so that shelves 60 can be and normally are both above and below the upper arm 33, which normally conceals the upper arm 33 and the lower arm 34 from the public. The pivot arms 33, 34 are always parallel to the shelves 60 so that the column arms 36 always fall in line with the shelf leg levers 69, and one pair of the keyholes 20 forms a pivot for the lower pivot arm 34, and a second pair of the keyholes 20 forms a pivot for the upper pivot arm 33. The column front surface 32 forms a backstop for keeping trays 80 and goods 81 upon the shelves 60.

The cart 10 is manufactured and shipped with the frame 12 complete and with the column 30, tilt mechanism 40 and pivot arms 33, 34 assembled and in place and operable. The shelves 60 for two units of the cart 10 are nested one on top of the other on the cart base 21. A second frame 12 is then nested upside down in the first frame 12 so that two cards 12 are shipped from the manufacturer in the volumn normally occupied by a single cart 10. The cart user then unstraps the two frames 12 and removes the upper frame 12 and turns it upright. The stop pins 45 are removed from the zero stop receivers 46 and the slides 41 and columns 30 are elevated to the position for maximum shelf tilt and locked in place. The shelves 60 are then installed where desired. If the cart 10 is to be used as a bread cart, the shelves 60 will most likely be placed in the "B" rotators 31 and keyholes 20. If for some other goods, the shelves 60 may be closer together or further apart, or positioned in an uneven combination as thought apropos. The slides 41 and columns 30 are then lowered to the zero position and the shelves 60 become horizontal and the stop pin 45 is placed back in the zero receiver 46.

When the cart 10 is used for bread, a tray 80 with eight loaves of bread 81 is loaded onto the shelf 60 from the front of the cart 10. The loaded cart 10 is then transported to a retailing site. The cart 10 is moved into the position where it will retail and the store clerk or route man withdraws the stop pin 45 from the zero receiver 46 and places the stop pin 45 in the desired receiver 46. The handle 52 is then grasped and the lock pin 55 withdrawn and the slide 41 and column 30 are raised to give the desired inclination to the shelves 60. The handle 52 is then released to engage the lock pin 55 and hold the column 30 and shelves 60 where desired.

The shelves 60 are intended to be self-feeding when inclined. Specifically, when a loaf of bread 81 is removed, the next up loaf slides down by gravity. Thus, the bottom of the shelves 60 is kept filled, and consumers completely empty the cart 10 because product is visible and easily removed. When all goods are sold off the cart 10, the cart 10 has its shelves 60 returned to horizontal and the cart 10 is wheeled out and returned to the bakery for reloading. The empty trays 80 remain upon the horizontal cart shelves 60 for the return trip and are then removed and refilled and replaced at the bakery.

The foregoing is an example of how the cart 10 may be used to reduce distribution costs and to increase sales of goods. The cart is particularly intended for the bakery industry but will probably be useful in other retailing industries also.

Although other advantages may be found and realized, and various and minor modifications suggested by those versed in the art, be it understood that I wish to embody within the scope of the patent warrented hereon, all such embodiments as reasonably and properly come within the scope of my contribution to the art.

I claim as my invention:

1. A combination transport and display cart having multiple bi-stable shelves which are easily moved from a stable horizontal transport position to a stable inclined display position, comprising:

a. an upright frame having opposed sides;

b. pivot means in each side for pivotal support of a plurality of shelves;

c. a plurality of shelves mounted in the frame, said shelves being substantially parallel to each other and being one above the other, each shelf being individually pivotally mounted in the pivot means and having a rotator lever spaced from the shelf's respective axis of rotation;

d. a shelf tilt column connected to said shelf rotator levers, said column being vertically and fore-aft movable with said levers through an arcuate path as the shelves remain parallel to each other and pivotally rotate either from the horizontal to the inclined position or from the inclined to the horizontal position;

e. vertically extendible tilt means connecting the column to the frame for vertically moving the column with respect to the frame, for pivoting the shelves between the positions; and f. a first hinge on the frame and connecting the tilt means directly to the frame, and a second hinge on the column and connecting the tilt means directly to the column.

2. The cart of claim 1, in which the tilt column has a front surface forming a backstop for retention of goods upon the shelves.

3. The cart of claim 1, in which the tilt means includes a lock mechanism in between the hinges.

4. Mobile display apparatus having multiple and easily tiltable shelves, comprising:

a. an upright frame having a base, wheels under the base for rolling the apparatus, and opposed sides extending upward from the base;

b. pivot means in each side for pivotally supporting a plurality of shelves;

c. a plurality of shelves pivotally mounted in said pivot means;

d. means connected between the frame and the shelves for tilting the shelves from a horizontal to a tilted position; and e. means in each of the shelves and in the frame sides for laterally restraining the frame sides both inwardly and outwardly with respect to each other.

5. The apparatus of claim 4, in which said restraining means comprises a key on each end of the shelf and a keyhole in each frame side.

6. The apparatus of claim 5, in which each key and keyhole are registrable only when the shelf is in the tilted position.

7. Display apparatus having multiple and easily tiltable shelves, comprising:

a. an upright frame having opposed sides and a fore end and an aft end;

b. pivot means in each side for pivotally supporting a plurality of shelves;

c. a shelf tilt column adjacent a first one of the fore-aft ends of the frame, said column being concurrently movable in both a vertical and fore-aft path determined by parallel equilength radii which are vertically spaced from each other and are swung from an upper and lower pivot means respectively, said upper and lower pivot means being in each side and being aligned with the shelf pivot means, said column having rotator means for rotating and angularly positioning shelves pivotally supported by said pivot means;

d. tilt means connecting said column to said frame for moving said column with respect to said frame, said tilt means being movably connected to both of said frame and said column, said tilt means being movable through a path between the frame and the path of the tilt column;

e. a pivot arm adjacent to the top of the column and the frame, said arm having a radius rod pivotally supporting a column arm which is connected from said radius rod to said column, said radius rod being of and determining the length of said radii;

f. a second and lower pivot arm adjacent a bottom of the column and the frame; and in which g. said tilt means is immediately adjacent to said column, and in which said lower column arm has a U-shaped off-set which extends around the front of said tilt means and column.

8. Apparatus according to claim 7, in which each arm is a U-shaped member having its end pivotally mounted in the pivot means and its base pivotally connected to the tilt column.

9. Display apparatus having multiple and easily tiltable shelves, comprising:

a. an upright frame having opposed sides and a fore end and an aft end;

b. pivot means in each side for pivotally supporting a plurality of shelves;

c. a shelf tilt column adjacent a first one of the fore-aft ends of the frame, said column being concurrently movable in both a vertical and fore-aft path determined by parallel equilength radii which are vertically spaced from each other and are swung from an upper and lower pivot means respectively, said upper and lower pivot means being in each side and being aligned with the shelf pivot means, said column having rotator means for rotating and angularly positioning shelves pivotally supported by said pivot means;

d. tilt means connecting said column to said frame for moving said column with respect to said frame, said tilt means being movably connected to both of said frame and said column and being movable through a path between the frame and the path of the tilt column;

e. lock means in said tilt means for locking the column and the rotator means in a predetermined position with respect to the frame so that shelves will be supported in a tilted attitude by the pivot means and the rotator means; and in which f. said lock means include tilt index means for positively holding the column at a plurality of such positions, each position being effective for a different angle of tilt.

10. Display apparatus having multiple and easily tiltable shelves, comprising:

a. an upright frame having opposed sides and a fore end and an aft end;

b. pivot means in each side for pivotally supporting a plurality of shelves;

c. a shelf tilt column adjacent a first one of the fore-aft ends of the frame, said column being concurrently movable in both a vertical and fore-aft path determined by parallel equilength radii which are vertically spaced from each other and are swung from an upper and lower pivot means respectively, said upper and lower pivot means being in each side and being aligned with the shelf pivot means, said column having rotator means for rotating and angularly positioning shelves pivotally supported by said pivot means;

d. tilt means connecting said column to said frame for moving said column with respect to said frame, said tilt means being movably connected to both of said frame and said column and being movable through a path between the frame and the path of the tilt column; and in which e. said tilt means comprises a slide mechanism having a slide and slideway pivotally connected to the frame and the column.

11. Apparatus according to claim 10, in which said slide mechanism has a lock mechanism for indexing the slide mechanism and the column at various positions, said lock mechanism having a handle for disengaging the lock mechanism, said handle being connected to rise and fall with the column.

12. Apparatus according to claim 10, in which said slide mechanism has a lock mechanism and means for positively engaging the lock mechanism at several heights, said slide mechanism also having stop means for stopping movement of the slide mechanism at a selected height.

13. Apparatus according to claim 12, in which said stop means comprises a stop pin and a plurality of indexed stop pin receivers, said stop pin when placed in any receiver, limiting the movement of the slide mechanism to an extent determined by which receiver the stop pin is in.

14. Apparatus according to claim 10, in which the slideway is pivotally attached to the frame and the slide is pivotally attached to the column.

15. Apparatus according to claim 10, in which the tilt means is rotatable from the back end and toward a front end of the apparatus.

16. Display apparatus having multiple and easily tiltable shelves, comprising:

a. an upright frame having opposed sides and a fore end and an aft end;

b. pivot means in each side for pivotally supporting a plurality of shelves;

c. a shelf tilt column adjacent a first one of the fore-aft ends of the frame, said column being concurrently movable in both a vertical and a fore-aft path determined by parallel equilength radii which are vertically spaced from each other and are swung from an upper and lower pivot means respectively, said upper and lower pivot means being in each side and being aligned with the shelf pivot means, said column having rotator means for rotating and angularly positioning shelves pivotally supported by said pivot means;

d. tilt means connecting said column to said frame for moving said column with respect to said frame, said tilt means being movably connected to both of said frame and said column and being movable through a path between the frame and the path of the tilt column; and e. at least one shelf rotatably mounted in the pivot means and the rotator means, and f. means in each said shelf for laterally restraining the opposed sides with respect to each other.

17. Apparatus according to claim 16, in which said restraining means comprise a key on each side of the shelf, said pivot means comprising keyholes.

18. Apparatus according to claim 17, in which each shelf key has means for engaging a frame on both the inside and outside of the keyhole.

19. Apparatus according to claim 18, in which each shelf key is a round wire having an inverted U-shape.

20. Apparatus according to claim 17, in which each keyhole is tilted an angle equal to the maximum angle of tilt of the shelves.

21. Apparatus according to claim 20, in which each shelf key is disposed perpendicular to the plane of the shelf, each key being engageable and disengageable with a respective keyhole and rotator means, only when the tilt column is at its maximum tilt position.

22. Apparatus according to claim 17, in which said shelf has a leg for engaging the column rotator means, said shelf being rotatable within the rotator means for engagement of the restraining means.

23. Display apparatus having multiple and easily tiltable shelves, comprising:

a. an upright frame having opposed sides and a fore end and an aft end;

b. pivot means in each side for pivotally supporting a plurality of shelves;

c. a shelf tilt column adjacent a first one of the fore-aft ends of the frame, said column being concurrently movable in both a vertical and fore-aft path determined by parallel equilength radii which are vertically spaced from each other and are swung from an upper and lower pivot means respectively, said upper and lower pivot means being in each side and being aligned with the shelf pivot means, said column having rotator means for rotating and angularly positioning shelves pivotally supported by said pivot means;

d. tilt means connecting said column to said frame for moving said column with respect to said frame, said tilt means being movably connected to both of said frame and said column and being movable through a path between the frame and the path of the tilt column; and e. a shelf made of formed wire, said shelf having a closed loop for supporting a tray, a leg extending from the loop for engaging the tilt means, an upward extending barrier on a front of the shelf for keeping trays upon the shelf when the shelf is tilted, and restraining means on each side of the loop for engaging the frame pivot means and supporting the shelf while laterally restraining the frame sides to each other.

24. Apparatus according to claim 23, in which the barrier and the restrainers are part of a separate U-shaped piece of wire welded to the closed loop.

25. Apparatus according to claim 23, including a shelf arm in between each restrainer and the closed loop.

26. Apparatus according to claim 23, including a bent foot on the leg, said foot being rotatable within the tilt column.

27. Apparatus according to claim 24, in which the barrier is spaced forwardly of the closed loop.

28. Apparatus according to claim 23, in which the restrainers are above the plane of the closed loop.

29. Apparatus according to claim 23, in which the tilt column has a surface forming a barrier for holding trays upon the shelf.

* * * * *